US006925704B1

(12) United States Patent
Schneekloth et al.

(10) Patent No.: US 6,925,704 B1
(45) Date of Patent: Aug. 9, 2005

(54) METHOD FOR MAKING HIGH POWER RESISTOR HAVING IMPROVED OPERATING TEMPERATURE RANGE

(75) Inventors: Greg Schneekloth, Schuyler, NE (US); Nathan Welk, Phoenix, AZ (US); Brandon Traudt, Columbus, NE (US); Joel Smejkal, Columbus, NE (US); Ronald J. Miksch, Columbus, NE (US); Steve Hendricks, Columbus, NE (US); David L. Lange, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 48 days.

(21) Appl. No.: 10/744,846

(22) Filed: Dec. 23, 2003

Related U.S. Application Data

(62) Division of application No. 10/441,649, filed on May 20, 2003.

(51) Int. Cl.[7] ..... H01C 17/00

(52) U.S. Cl. ..... 29/610.1; 29/611; 29/612; 29/613; 29/620; 29/827; 29/832; 29/850; 156/242

(58) Field of Search ..... 29/611, 620, 610.1, 29/612, 827, 832, 850, 613; 338/51, 52, 306, 338/313, 309, 53, 54–59; 156/242, 245

(56) References Cited

U.S. PATENT DOCUMENTS 3,525,065 A 8/1970 Person
3,541,489 A 11/1970 Person
3,649,944 A 3/1972 Caddock
3,955,169 A 5/1976 Kerfoot
4,064,477 A 12/1977 Thompson
4,196,411 A * 4/1980 Kaufman ..... 338/314
4,455,744 A 6/1984 Zandman
4,719,443 A 1/1988 Salay
4,829,553 A * 5/1989 Shindo et al. ..... 338/309
5,179,366 A * 1/1993 Wagner ..... 338/313
5,291,175 A 3/1994 Ertmer
5,304,977 A 4/1994 Caddock
5,355,281 A 10/1994 Adelmann
5,481,241 A 1/1996 Caddock
5,621,378 A 4/1997 Caddock (Continued)

OTHER PUBLICATIONS

Isabellenhute PMA Precision Resistor 01/99.
Isabellenhute PMD Precision Resistor.
Isabellenhute PMU Precision Resistor.
Isabellenhute PMB Precision Resistor.
Isabellenhute SMH Precision Resistor.

*Primary Examiner*—A. Dexter Tugbang
*Assistant Examiner*—Tai Van Nguyen
(74) *Attorney, Agent, or Firm*—McKee, Voorhees & Sease, PLC.

(57) ABSTRACT

A high power resistor includes a resistance element with first and second leads extending out from the opposite ends thereof. A heat sink of dielectric material is in heat conducting relation to the resistance element. The heat conducting relationship of the resistance element and the heat sink render the resistance element capable of operating as a resistor between the temperatures of −65° C. to +275° C. The heat sink is adhered to the resistance element and a molding compound is molded around the resistance element.

6 Claims, 4 Drawing Sheets

U.S. PATENT DOCUMENTS 5,739,743 A * 4/1998 Mazzochette ..... 338/313
5,753,889 A 5/1998 Kondo
5,945,905 A * 8/1999 Mazzochette ..... 338/51
5,999,085 A 12/1999 Szwarc
6,114,752 A 9/2000 Huang
6,148,502 A 11/2000 Gerber
6,340,927 B1 1/2002 Peschl
6,404,324 B1 6/2002 Witt
6,510,605 B1 1/2003 Smejkal
6,528,860 B2 3/2003 Okamoto
6,660,651 B1 12/2003 Markle

* cited by examiner

METHOD FOR MAKING HIGH POWER RESISTOR HAVING IMPROVED OPERATING TEMPERATURE RANGE

CROSS-REFERENCE TO RELATED APPLICATIONS

This application is a Divisonal of U.S. patent application Ser. No. 10/441,649, filed May 20, 2003 of which is herein incorporated by reference in its entirety.

BACKGROUND OF THE INVENTION

The present invention relates to a high power resistor having improved operating temperature range and method for making same.

The trend in the electronic industry has been to make high power resistors in smaller package sizes so that they can be incorporated into smaller circuit boards. The ability of a resistor to perform is demonstrated by a derating curve, and a derating curve of typical prior art devices as shown in FIG. 9. FIG. 9 shows a derating curve 68 having a horizontal portion 70 which commences at −55° C. and which extends horizontally to +70° C. The resistor then begins to reduce in efficiency as shown by the numeral 72, and at +150° C. it becomes inoperative.

Therefore, a primary object of the present invention is the provision of a high power resistor having an improved operating temperature range, and a method for making same.

A further object of the present invention is the provision of a high power resistor which is operable between −65° C. and +275° C.

A further object of the present invention is the provision of a high power resistor which utilizes an adhesive for attaching a heat sink to the resistor element.

A further object of the present invention is the provision of a high power resistor and method for making same which utilizes an anodized aluminum heat sink.

A further object of the present invention is the provision of a high power resistor and method for making same which utilizes an improved dielectric molding material surrounding the resistor for improving heat dissipation.

A further object of the present invention is the provision of a high power resistor and method for making same which provides an improved operating temperature and which occupies a minimum of space.

A further object of the present invention is the provision of an improved high power resistor and method for making same which is efficient in operation, durable in use, and economical to manufacture.

BRIEF SUMMARY OF THE INVENTION

The foregoing objects may be achieved by a high power resistor comprising a resistance element having first and second opposite ends. A first lead and a second lead extend from the opposite ends of the resistance element. A heat sink of dielectric material is capable of conducting heat away from the resistance element and is connected to the resistance element in heat conducting relation thereto so as to conduct heat away from the resistance element. The heat conducting relationship of the resistance element and the heat sink render the resistance element capable of operating as a resistor between temperatures of from −65° C. to +275° C.

According to one feature of the present invention the heat sink is comprised of anodized aluminum. This is the preferred material, but other materials such as beryllium oxide or aluminum oxide may be used. Also, copper that has been passivated to create a non-conductive outer surface may also be used.

According to another feature of the present invention, an adhesive attaches the heat sink to the resistance element. The adhesive has the capability of permitting the resistor to produce resistively throughout heat temperatures in the range of from −65° C. to +275° C. The adhesive maintains its adhesion of the resistance element to the heat sink in the range from −65° C. to +275° C. The specific adhesive which is Applicant's preferred adhesive is Model No. BA-813J01, manufactured by Tra-Con, Inc. under the name Tra-Bond, but other adhesives may be used.

According to another feature of the present invention a dielectric molding material surrounds the resistance element, the adhesive and the heat sink. Examples of molding compounds are liquid crystal polymers manufactured by DuPont (having an address of Barley Mill Plaza, Building No. 22, Wilmington, Del. 19880) under the trademark ZENITE, and under the Model No. 6130L; and a liquid crystal polymer manufactured under the trademark VECTRA, Model No. E130I, by Tucona, a member of the Hoechst Group, 90 Morris Avenue, Summit, N.J. 07901.

The method of the present invention comprises forming a resistance element having first and second opposite ends and first and second leads extending from the first and second opposite ends respectively. A heat sink is attached to the resistance element in heat conducting relation thereto so as to render the resistance element capable of producing resistance in the temperature range of −65° C. to +275° C.

The method further comprises forming the resistance element so that the resistance element includes a flat resistance element face. The method includes attaching a flat heat sink surface to the flat resistance element face.

The method further comprises using an adhesive to attach the heat sink to the resistance element.

The method further comprises molding a dielectric material completely around the resistance element, the adhesive, and the heat sink.

The method further comprises forming a pre-molded body on opposite sides of the heat sink before attaching the heat sink to the resistance element.

DETAILED DESCRIPTION OF THE PREFERRED EMBODIMENT

Figure 1:
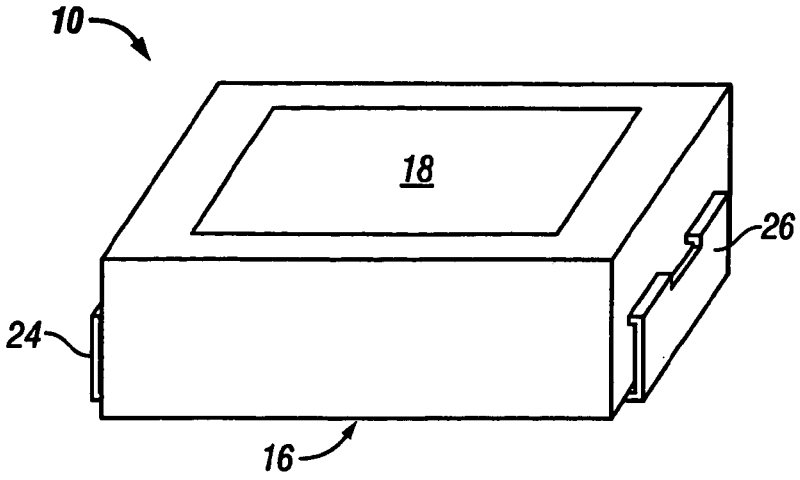
FIG. 1 is a perspective view of the high power resistor of the present invention.

Referring to the drawings the numeral 10 generally designates a resistor body made according to the present invention. Resistor body 10 includes leads 24, 26 which extend outwardly from the ends of a dielectric body 16. The leads 24, 26 are bent downwardly and under the bottom surface of dielectric body 16. An exposed heat sink 18 is shown on the top surface of the body 10.

Figure 2:
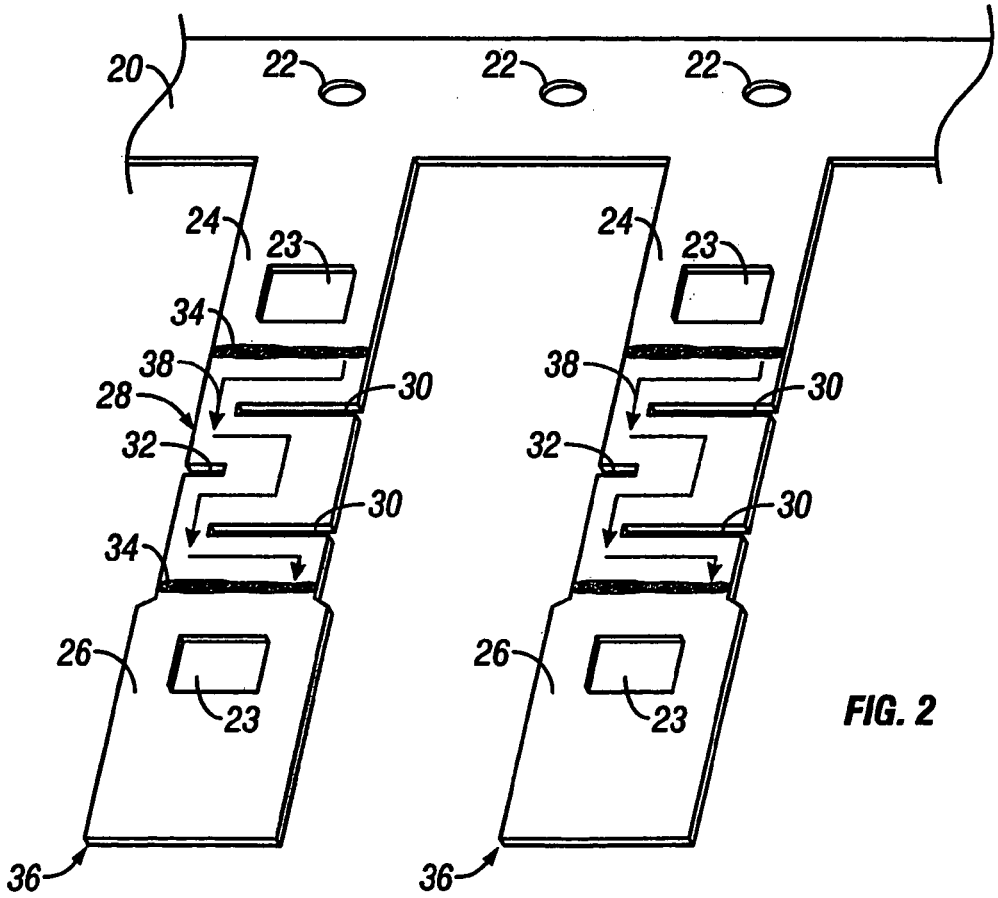
FIG. 2 is a perspective view of a strip of material having the various resistor elements formed thereon.

FIG. 2 illustrates the first step of development and manufacture of the present invention. An elongated strip 20 includes a plurality of resistor blanks 36 extending there from. Strip 20 includes a plurality of circular indexing holes 22 which are adapted to receive pins from a conveyor. The pins move the various blanks 36 to each of various stations for performing different operations on the blanks 36.

Each blank 36 includes a pair of square holes 23 which facilitate the bending of the leads 24, 26. Between the leads 24, 26 is a resistance element 28, and a pair of weld seams 34 separate the resistance element 28 from the first and second leads 24, 26. Preferably, the first and second leads 24, 26 are made of a nickel/copper alloy, and the resistance element 28 is formed of a conventional resistance material.

Extending inwardly from one of the sides of the resistance element 28 are a plurality of slots 30 and extending inwardly from the opposite side of resistance element 28 is a slot 32. The number of slots 30, 32 may be increased or decreased to achieve the desired resistance. The resistance is illustrated in the drawings by arrow 38 which represents the serpentine current path followed as current passes through the resistance element 28. Slots 30, 32 may be formed by cutting, abrading, or preferably by laser cutting. Laser beams can be used to trim the resistor to the precise resistance desired.

Figure 3:
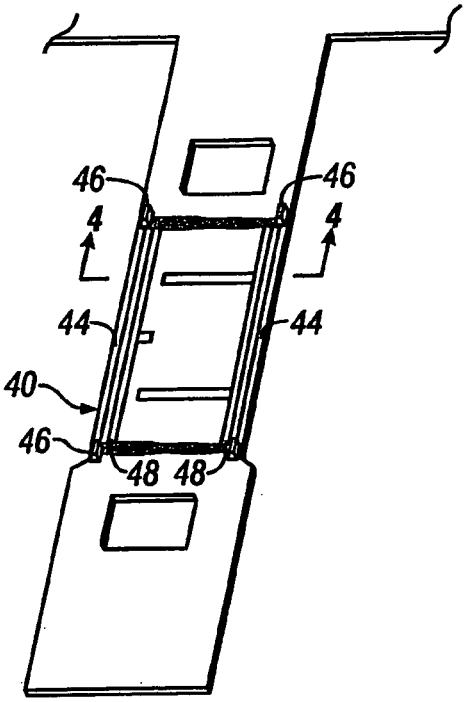
FIG. 3 is a perspective view of a similar resistance element such as shown in FIG. 2, but showing the pre-molded material and the adhesive material applied thereto.
Figure 4:
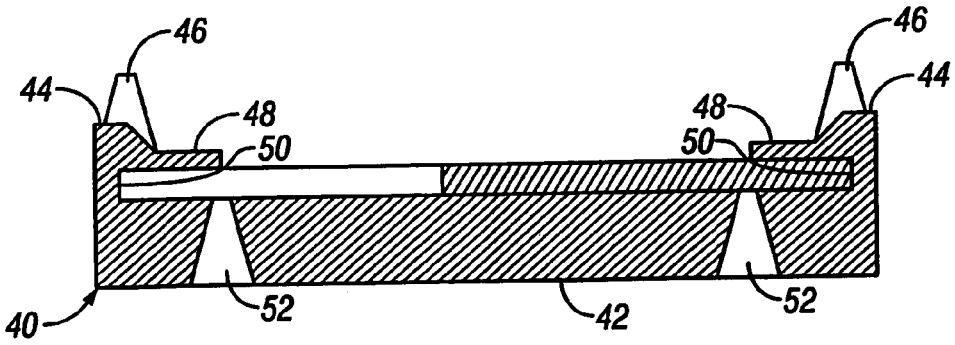
FIG. 4 is a sectional view taken along line 4—4 of FIG. 3.

FIG. 3 shows the next step in the manufacturing process. The blank 36 is pre-molded to form a pre-mold body 40. Pre-molded body 40 includes a bottom portion 42 (FIG. 4), upstanding ridges 44 which extend along the opposite edges of the resistance element 28, and four lands or posts 46 at the four corners of the resistance element 28. Extending inwardly from the upstanding ridges 44 are two spaced apart inner flanges 48 which form slots 50 around the opposite edges of resistance element 28. A pair of V-shaped bottom grooves 52 extend along the under surface of the bottom portion 42 of the pre-mold 40.

Figure 5:
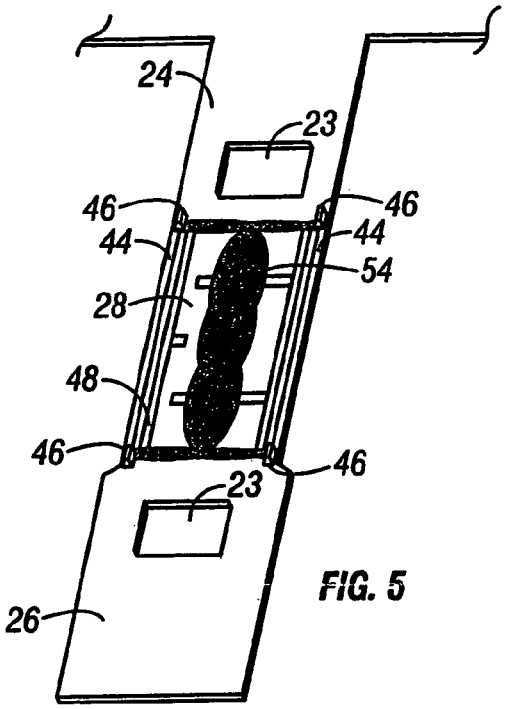
FIG. 5 is a perspective view similar to FIG. 3 showing the adhesive applied to the resistance element.

FIG. 5 is the same as FIG. 3, but shows an amount of adhesive 54 which has been applied to the central portion of the resistance element 28. The adhesive should have the properties of maintaining its structural integrity and maintaining its adhesive capabilities in the range of temperatures from −65° C. to +275° C. An example of such an adhesive is an epoxy adhesive manufactured by Tra-Con, Inc., 45 Wiggins Avenue, Bedford, Mass. 01730 under the trademark TRA-BOND, Model No. BA-813J01.

Figure 6:
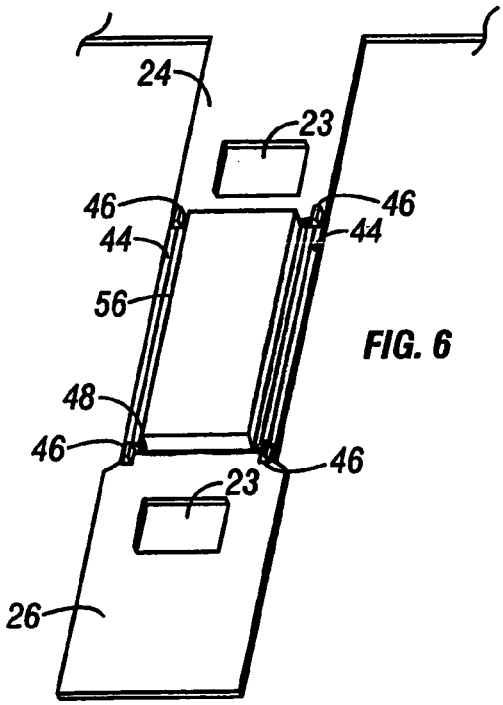
FIG. 6 is a view similar to FIGS. 3 and 5 showing the heat sink in place.
Figure 7:
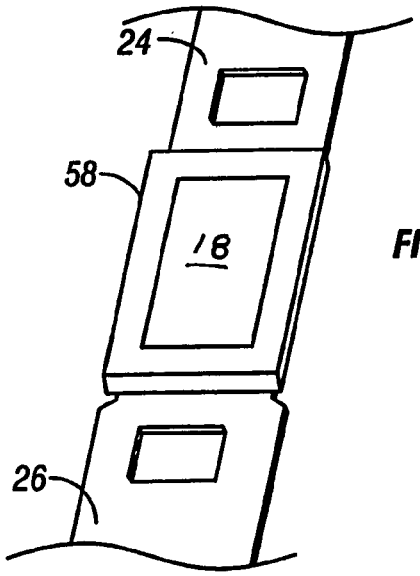
FIG. 7 is a perspective view of the resistor after the molding process is complete.

Referring to FIG. 6, a body 56 of anodized aluminum is placed over the adhesive 54 so that it is in heat conducting connection to the resistance element 28. Thus heat is conducted from the resistance element 28 through the adhesive 54, and through the anodized aluminum heat sink 56 to dissipate heat that is generated by the resistance element 28.

After the heat sink 56 is attached to the resistance element 28 as shown in FIG. 6, the entire resistance element 28, pre-mold 40, adhesive 54, and heat sink 56 are molded in a molding compound to produce the molded body 58. The molded body 58 includes an exposed portion 18 so that heat may be dissipated directly from the heat sink 56 to the atmosphere.

The molding compound for molding the body 58 may be selected from a number of molding compounds that are dielectric and capable of conducting heat. Examples of such molding compounds are liquid crystal polymers manufactured by DuPont at Barley Mill Plaza, Building 22, Wilmington, Del. 19880 under the trademark ZENITE, Model No. 6130L; or manufactured by Tucona, a member of Hoechst Group, 90 Morris Avenue, Summit, N.J. 07901 under the trademark VECTRA, Model No. E130I.

The leads 24, 26 are bent downwardly and curled under the body 16 as shown in FIG. 1.

Figure 8:
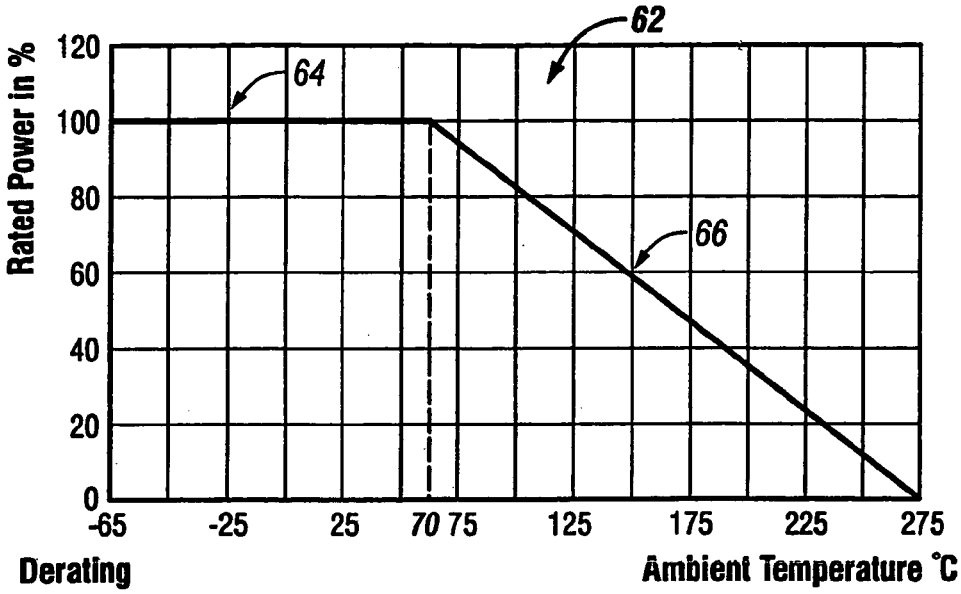
FIG. 8 is a derating curve of the present invention.

FIG. 8 illustrates the derating curve produced by the resistor of the present invention. The derating curve is designated by the numeral 62 and includes a horizontal portion commencing at −65° and remaining horizontal up to +70° C. Then the derating curve declines downwardly as designated by the numeral 66 until it reaches 0 performance at +275° C. Thus the device of the present invention operates as a resistor between the temperature ranges of −65° C. to +275° C.

Figure 9:
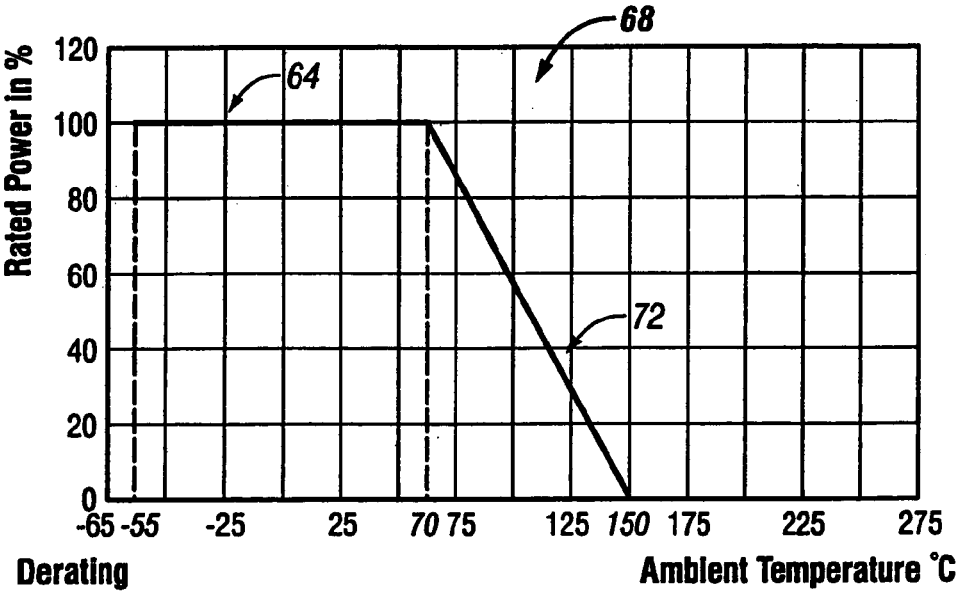
FIG. 9 (Prior Art)
FIG. 9 is a derating curve of prior art resistors.

As can be seen by comparing FIG. 8 to FIG. 9, the performance of the resistor of the present invention commences at 10° below the lowest temperature of the average prior art device and functions as a resistor up to 125° higher than the capabilities of prior art resistors. The resistor of the present invention will function in this temperature range to produce ohmage in the range of from 0.0075 ohms to 0.3 ohms, and to dissipate heat up to approximately 5 or 6 watts.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method for making a high power resistor comprising:

forming a resistor blank comprising a resistance element, a first lead, and a second lead; the resistance element having first and second opposite ends, first and second opposite side edges, a first flat surface, and a second flat surface opposite from the first flat surface; the first and second leads extending from the first and second opposite ends of the resistance element;

making a pre-mold body having first and second slots fitted around the first and second opposite side edges of the resistance element and having a bottom portion engaging the first flat surface of the resistance element;

depositing an electrically non conductive and heat conductive adhesive on the second flat surface of the resistance element, the adhesive having the properties of maintaining the structural integrity and adhesive capabilities of the adhesive in the temperature range of −65° C. to +275° C.;

placing a heat sink in contact with the adhesive with the adhesive between the heat sink and the second flat surface of the resistance element whereby the adhesive will attach the heat sink to the second flat surface of the resistance element and will conduct heat from the resistance element to the heat sink;

molding a molded body completely around the pre-molded body, the resistance element, and the adhesive, and partially around the heat sink;

exposing a portion of the heat sink to the atmosphere through the molded body;

whereby the heat conducting relationship of the resistance element, the adhesive and the heat sink render the resistance element capable of operating as a resistor between temperatures of from −65° C. to +275° C.

2. The method of claim 1 and farther comprising welding the first and second leads to the first and second ends of the resistance element.

3. The method of claim 1 wherein the molded body includes first and second ends and a bottom surface, the method further comprising extending the first and second leads outside the first and second ends of the molded body and bending the first and second leads into facing relation with the bottom surface of the molded body.

4. A method for making a high power resistor comprising:

forming a resistor blank comprising a non-e lm resistance element, a first lead, and a second lead, the resistance element having first and second opposite ends, first and second opposite side edges, a first flat surface, and a second flat surface opposite from the first flat surface, the first and second leads extending from the first and second opposite ends of the resistance element;

depositing an electrically non conductive and heat conductive adhesive on the second flat surface of the resistance element, the adhesive having the properties of maintaining the structural integrity and adhesive capabilities of the adhesive in the temperature range of −65° C. to +275° C.;

placing a heat sink in contact with the adhesive with the adhesive between the heat sink and the second flat surface of the resistance element whereby the adhesive will attach the heat sink to the second flat surface of the resistance element and will conduct heat from the resistance element to the heat sink;

molding a molded body completely around the resistance element and the adhesive, and partially around the heat sink;

exposing a portion of the heat sink to the atmosphere through the molded body;

whereby the heat conducting relationship of the resistance element, the adhesive and the heat sink render the resistance element capable of operating as a resistor between temperatures of from −65° C. to +275° C.

5. A method for making a high power resistor comprising:

making a resistor blank comprising a non-film resistance element having a power rating of less than 6 watts, a first lead, and a second lead, the resistance element having first and second opposite ends, first and second opposite side edges, a first flat surface, and a second flat surface opposite from the first flat surface, the first and second leads extending from the first and second opposite ends of the resistance element;

depositing an electrically non conductive and heat conductive adhesive on the second flat surface of the resistance element, the adhesive having the properties of maintaining the structural integrity and adhesive capabilities of the adhesive in the temperature range of −65° C. to +275° C.;

placing a heat sink in contact with the adhesive with the adhesive between the heat sink and the second flat surface of the resistance element whereby the adhesive will attach the heat sink to the second flat surface of the resistance element and will conduct heat from the resistance element to the heat sink;

molding a molded body completely around the resistance element and the adhesive, and partially around the heat sink;

exposing a portion of the heat sink to the atmosphere through the molded body;

whereby the heat conducting relationship of the resistance element, the adhesive and the heat sink cause the resistance element to function at 100% of the rated wattage between the temperatures of −65° C. and +70° C.

6. The method according to claim 5 and further comprising forming a pre-mold body having first and second slots that embrace the first and second opposite edges of the resistance element, toe molding of the molded body being completely around the pre-mold body.

* * * * *

UNITED STATES PATENT AND TRADEMARK OFFICE

CERTIFICATE OF CORRECTION

PATENT NO. : 6,925,704 B1
DATED : August 9, 2005
INVENTOR(S) : Schneekloth et al.

It is certified that error appears in the above-identified patent and that said Letters Patent is hereby corrected as shown below:

Column 5,
Line 13, should read:
-- forming a resistor blank comprising a non-film resistance --.

Column 6,
Line 35, should read:
-- resistance element, molding of the molded body being --.

Signed and Sealed this

Eighteenth Day of October, 2005

JON W. DUDAS
*Director of the United States Patent and Trademark Office*